US007128290B1

(12) United States Patent
Bandholz et al.

(10) Patent No.: US 7,128,290 B1
(45) Date of Patent: Oct. 31, 2006

(54) SPOOL HAVING A DUAL PURPOSE CAM

(75) Inventors: Brent A. Bandholz, West Allis, WI (US); Robert L. Schanke, New Berlin, WI (US)

(73) Assignee: Brady Worldwide, Inc., Milwaukee, WI (US)

( * ) Notice: Subject to any disclaimer, the term of this patent is extended or adjusted under 35 U.S.C. 154(b) by 0 days.

(21) Appl. No.: 10/885,452

(22) Filed: Jul. 6, 2004

(51) Int. Cl.
*B65H 19/28* (2006.01)
*B65H 75/28* (2006.01)

(52) U.S. Cl. ..... 242/532.5; 242/575.3; 242/586.5

(58) Field of Classification Search ..... 242/575.3, 242/571.6, 571.7, 579, 533.7, 533, 574, 597, 242/597.3, 571, 571.3, 571.4, 571.5, 559.3, 242/559.4, 532.5, 586, 586.4, 586.5, 586.6, 242/587, 332.7
See application file for complete search history.

(56) References Cited

U.S. PATENT DOCUMENTS

| | | | | |
|---|---|---|---|---|
| 688,143 | A | 12/1901 | Windle | |
| 1,494,396 | A | 5/1924 | Wendt | |
| 1,530,991 | A | 3/1925 | Forbes | |
| 1,885,192 | A | 11/1932 | Elssner et al. | |
| 1,979,423 | A | 11/1934 | Tondreau | |
| 2,196,489 | A | 4/1940 | Bennett | |
| 2,558,689 | A | 6/1951 | Miller | |
| 2,576,254 | A | 11/1951 | Fletcher | |
| 2,628,789 | A * | 2/1953 | Maxwell | 242/586.5 |
| 2,790,246 | A | 4/1957 | May | |
| 4,043,440 | A | 8/1977 | Busch | |
| 4,531,685 | A * | 7/1985 | White | 242/586.5 |
| 4,645,136 | A | 2/1987 | Woodley et al. | |
| 4,798,350 | A | 1/1989 | Jorgesen et al. | |
| 4,893,765 | A | 1/1990 | Randolph | |
| 5,196,082 | A | 3/1993 | Randolph | |
| 5,267,704 | A | 12/1993 | Kitamura et al. | |
| 5,758,841 | A | 6/1998 | Ayffre et al. | |
| 6,021,972 | A | 2/2000 | Inoue et al. | |
| 6,307,583 | B1 | 10/2001 | Randolph et al. | |
| 6,540,167 | B1 * | 4/2003 | Sasaki et al. | 242/332.4 |

FOREIGN PATENT DOCUMENTS

| | | |
|---|---|---|
| GB | 673946 | 6/1952 |
| GB | 1137150 | 12/1968 |
| GB | 2 211 824 A | 7/1989 |
| GB | 2 377 909 A | 1/2003 |
| WO | WO 02/055420 A1 | 7/2002 |

* cited by examiner

*Primary Examiner*—John Q. Nguyen
*Assistant Examiner*—William E. Dondero
(74) *Attorney, Agent, or Firm*—Quarles & Brady LLP

(57) ABSTRACT

A spool suitable for winding material thereon includes an axially extending body having a proximal end and a distal end joined by an outer surface. A cam is rotatably mounted adjacent to the body for rotatable movement between a closed position and an open position. In the closed position, the cam secures the material to the spool and a portion of the cam extends radially outwardly from the body to define a first effective diameter of the spool. In the open position, the cam is spaced from the body to release the material secured to the spool and the portion of the cam retracts toward the body to define a second effective diameter of the spool which is less than the first effective diameter.

18 Claims, 6 Drawing Sheets

SPOOL HAVING A DUAL PURPOSE CAM

CROSS REFERENCES TO RELATED APPLICATIONS

Not Applicable.

STATEMENT REGARDING FEDERALLY SPONSORED RESEARCH

Not Applicable.

TECHNICAL FIELD

This invention relates to spools for winding material thereon, and in particular to a spool including a cam for securing material to the spool and changing the effective diameter of the spool.

DESCRIPTION OF THE BACKGROUND ART

Spools are used in various machines for supplying and rewinding material. For example, in a printer, such as a thermal printer, a printing media supply spool includes a roll of printing material that is unwound to feed the printing media past a print head. The print head transfers ink from an ink ribbon onto the printing media. Printing media, such as labels, can include a releasable liner that is peeled away from the printed labels upon ejection of the label from the printer. The liner can then be wound onto a liner rewind spool and collected for removal and disposal. Likewise, the ink ribbon that supplies ink for transferring onto the printing media is supplied by an ink ribbon supply spool that carries a roll of ink ribbon. The ink ribbon unwinds from the ink ribbon supply spool as it is fed past the print head. The used ink ribbon is wound onto a rewind spool for collection and subsequent disposal.

Many spools require a core mounted on a rotatable spool body for collecting the liner or ribbon. The core simplifies removal of the material wound thereon by allowing the material to be removed as a unit. Unfortunately, the core is a disposable part that must be provided when printing, and thus increases the cost of printing. In addition, loading the core on the spool body and securing a leading edge of the liner or ribbon to the core, such as by taping, increases the number of steps, and thus the complexity, necessary to set up a printer. Improper set up of the printer can delay the printing process or even ruin the initial run of printed material.

Coreless spools that eliminate the need for a core have been introduced that wind material directly onto the spool body to eliminate these problems. However, removal of material wound directly onto the spool body is difficult. For example, if the material is wound too tight onto the spool body, a user may have to unwind the material from the coreless spool which is time consuming. Moreover, the material being wound onto the spool must be secured relative to the spool whether it is to a core or the spool body. Therefore, a need exists for a spool that provides a simple method for securing a leading edge of material relative to the spool and removing material wound onto a spool without winding the material on a removable core.

SUMMARY OF THE INVENTION

The present invention provides a spool suitable for winding material thereon. The spool includes an axially extending body having a proximal end and a distal end joined by an outer surface. A cam is rotatably mounted adjacent to the body for rotatable movement between a closed position and an open position. In the closed position, the cam secures the material to the spool and a portion of the cam extends radially outwardly from the body to define a first effective diameter of the spool. In the open position, the cam is spaced from the body to release the material secured to the spool and the portion of the cam retracts toward the body to define a second effective diameter of the spool which is less than the first effective diameter.

A general objective of the present invention is to provide a spool that includes a mechanism that secures a free end of material that is wound thereon. This objective is accomplished by providing a cam disposed in a slot that in a closed position secures the free end of the material to the spool.

Another objective of the present invention is to provide a spool that allows easy removal of material wound thereon. This objective is accomplished by providing a cam that in a closed position defines an effective spool diameter, and in an open position defines an effective spool diameter that is smaller to allow easy removal of material wound thereon.

The foregoing and other objectives and advantages of the invention will appear from the following description. In the description, reference is made to the accompanying drawings which form a part hereof, and in which there is shown by way of illustration a preferred embodiment of the invention. Such embodiment does not necessarily represent the full scope of the invention, however, and reference is made therefore to the claims herein for interpreting the scope of the invention.

DETAILED DESCRIPTION OF THE PREFERRED EMBODIMENTS

Figure 1:
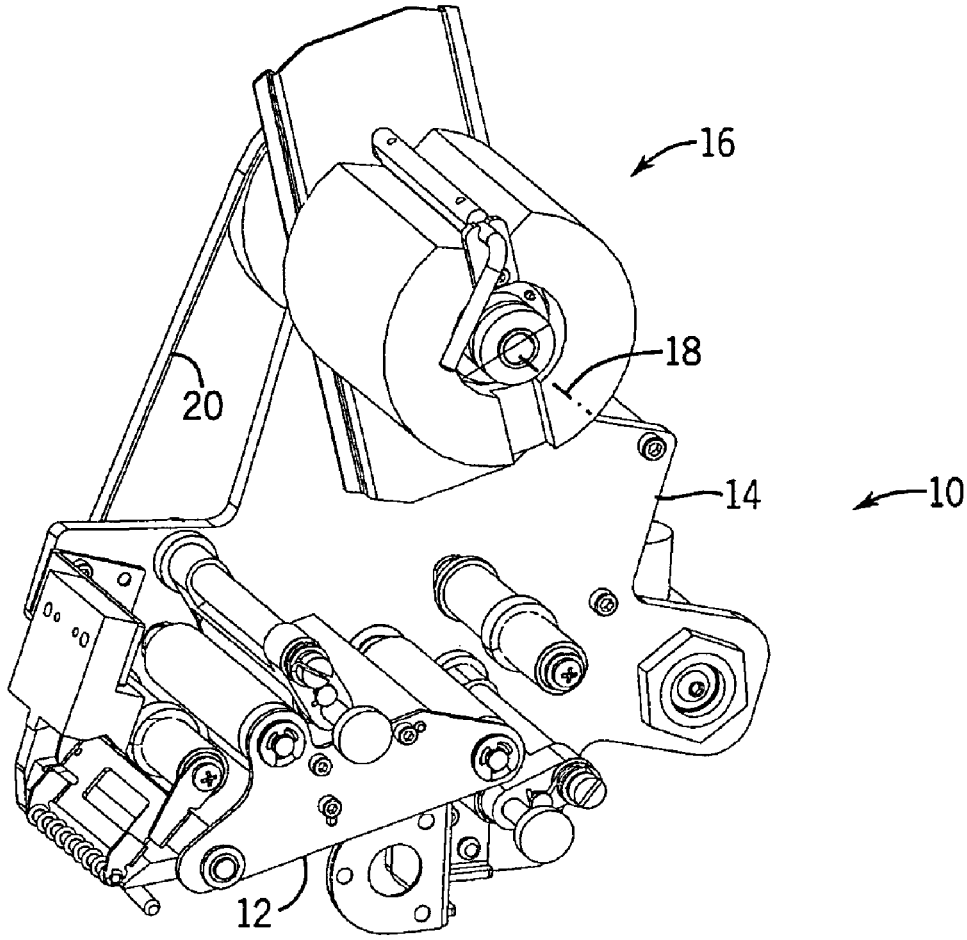
FIG. 1 is a perspective view of a portion of a printing system including a release liner rewind spool incorporating the present invention.

As shown in FIG. 1, a printing system 10 includes typical printer components, such as a print media drive mechanism 12 mounted to an internal wall 14 which drives print media past a print head that prints indicia onto the print media. In the present embodiment the print media includes a release liner that is wound onto a release liner rewind spool 16. The typical printer components are known in the art and need not be described in detail. The release liner rewind spool 16, however, incorporates the present invention and is described in detail below.

The release liner rewind spool 16 is cantilevered from the internal wall 14, and winds thereon the release liner separated from the print media. A belt 20 coupled to a motor by an overdriven clutch rotatably drives the spool 16 about a spool axis 18 to wind the release liner directly onto the spool 16. Advantageously, by winding the release liner directly onto the spool 16, a core mounted on the spool for winding the release liner thereon is not required. Although the release liner rewind spool 16 is especially suitable for winding a release liner thereon, it can be used for winding any material, such as an ink ribbon, paper, tape, fabric, and the like without departing from the scope of the invention.

Figure 2:
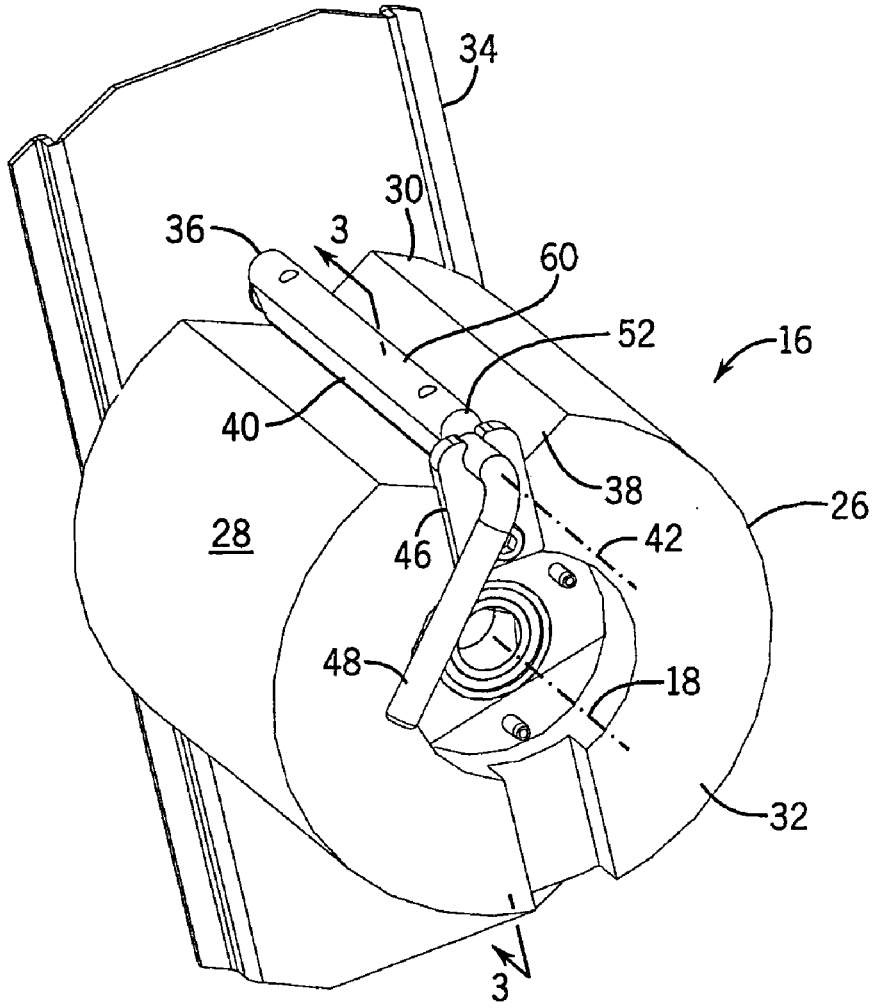
FIG. 2 is a perspective view of the rewind spool of FIG. 1.
Figure 3:
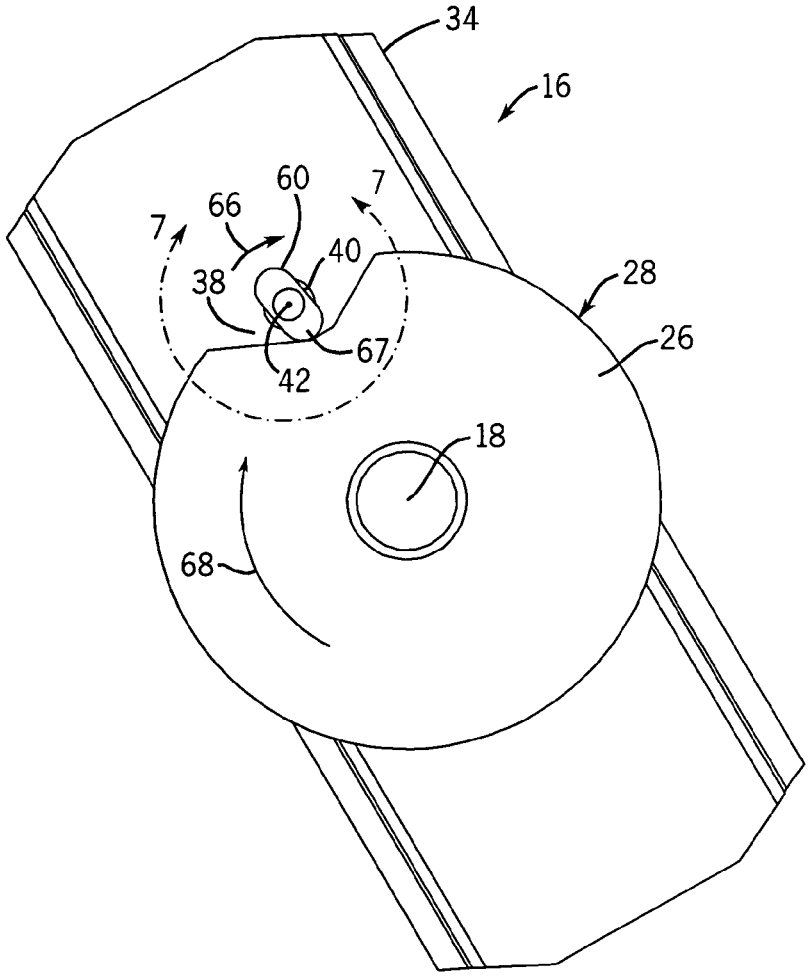
FIG. 3 is a sectional view along line 3—3 of FIG. 2 with the cam in the closed position.
Figure 4:
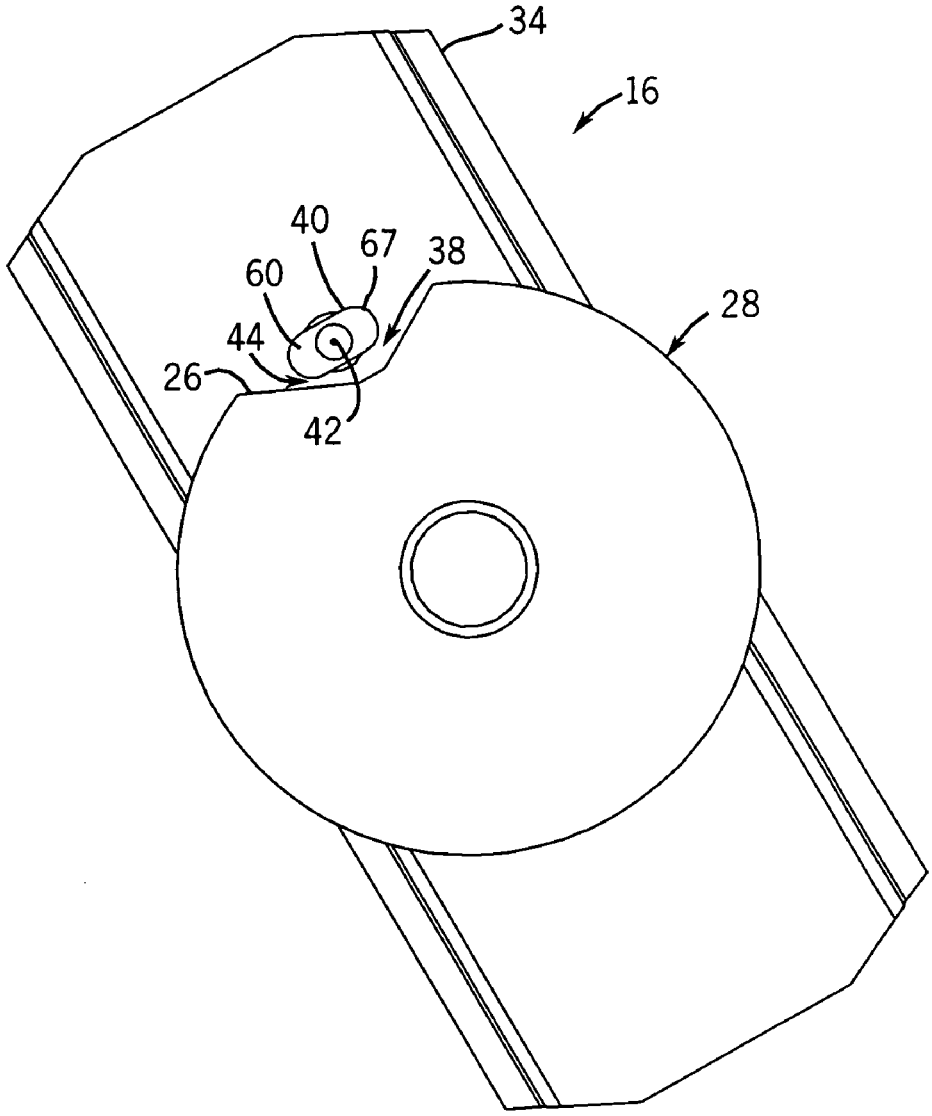
FIG. 4 is the sectional view of FIG. 3 with the cam in the open position.
Figure 5:
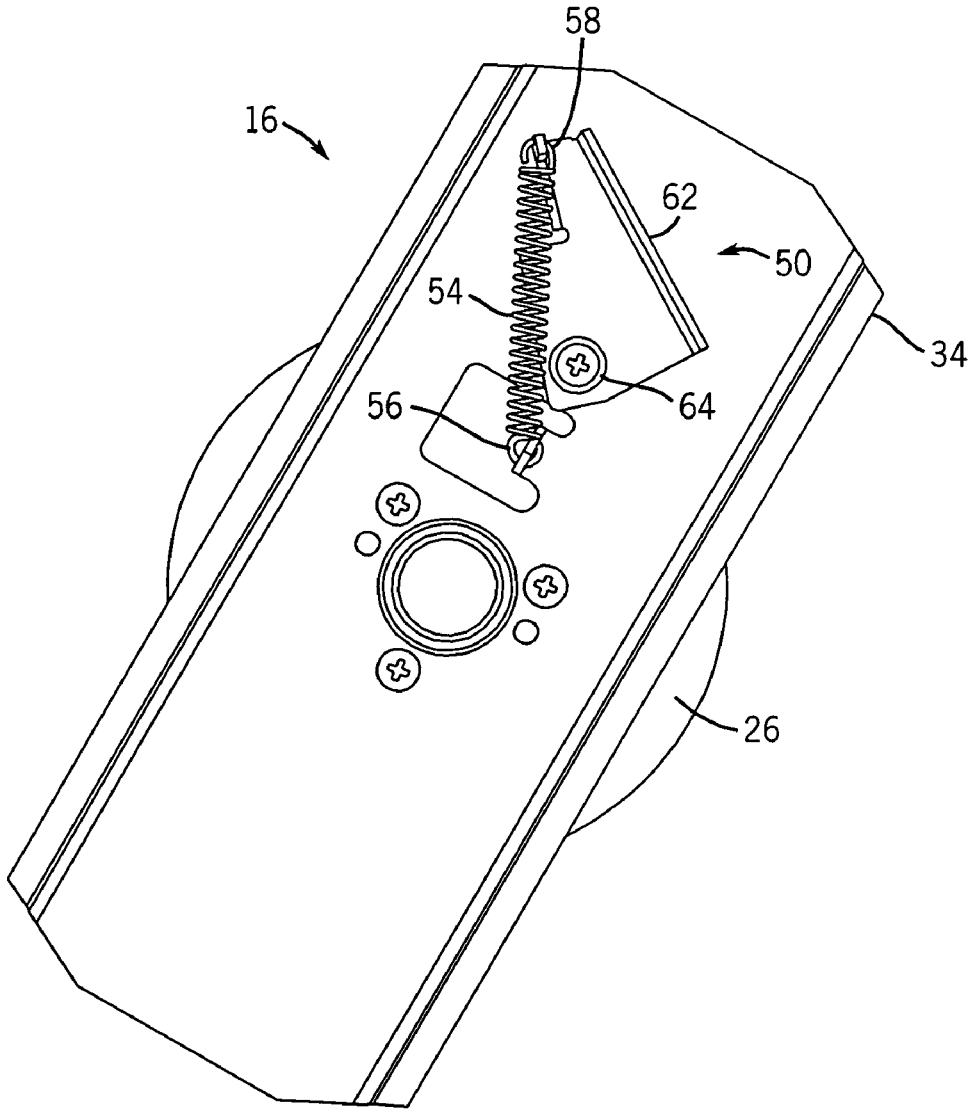
FIG. 5 is a rear view of the spool of FIG. 1 showing the over-center biasing mechanism when the cam is in the closed position.
Figure 6:
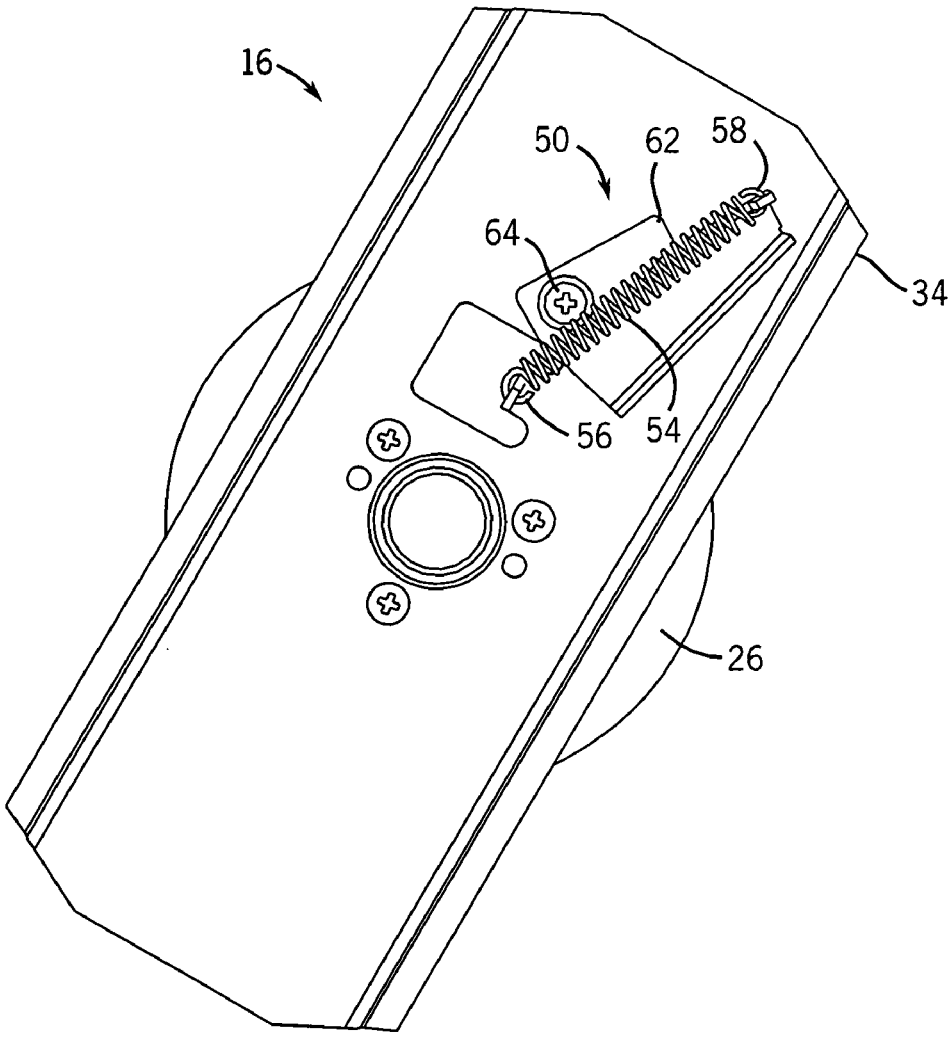
FIG. 6 is a rear view of the spool of FIG. 1 showing the over-center biasing mechanism when the cam is in the open position.

In the embodiment disclosed in FIGS. 2–4, the release liner rewind spool 16 includes a spool body 26 for winding the liner thereon. Preferably, the spool body 26 is substantially cylindrical, and includes an outer surface 28 extending between a proximal end 30 and a distal end 32. The proximal end 30 of the spool body 26 is fixed to a radially extending flange 34. An axially extending slot 38 formed in the body outer surface 28 receives a dual purpose cam 40 that is rotatable about a cam axis 42 between a closed position (shown in FIG. 3) and an open position (shown in FIG. 4).

The cam 40 is disposed in the slot 38, and has a proximal end 36 pivotally mounted to the flange 34 for rotatable movement about the cam axis 42 which is, preferably, substantially parallel to the spool axis 18. A bracket 46 fixed to the body distal end 32, using methods known in the art, such as a screw, rivet, adhesive, and the like, supports a distal end 52 of the cam 40. Although a cam extending axially in the slot is preferred, one or more cams can be provided in the slot that extend transverse to the slot and are rotatably mounted for rotational movement about axes that are transverse to the spool axis without departing from the scope of the invention. Moreover, one or more slots, each provided with one or more cams can be provided, wherein the free end of the release liner is secured in one of the slots using the one or more cams disposed in that slot and the remaining slots and cams can be used to modify the effective diameter of the spool without departing from the scope of the invention.

Figure 7:
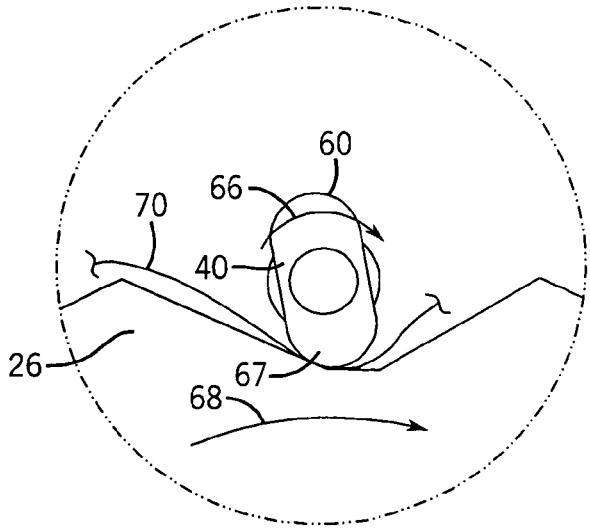
FIG. 7 is a detailed view of the spool of FIG. 1 with a release liner captured between the cam and spool body of FIG. 2.

In the closed position shown in FIGS. 3 and 7, the cam 40 captures the release liner 70 between a trapping portion 67 of the cam 40 and the spool body 26. A radially outwardly extending portion 60 of the cam 40 extends away from the spool body 26 to define an effective spool diameter that is greater than the effective spool diameter defined by the spool body 26 alone.

In the open position shown in FIG. 4, the cam 40 defines a gap 44 between the spool body 26 in the slot 38 and the cam 40 to disengage the release liner. In addition, the radially outwardly extending portion 60 of the cam 40 retracts toward the body outer surface 28, and preferably into the slot 38, to reduce the effective diameter of the spool 16 for easy removal of the release liner wound onto the spool 16. Although mounting the dual purpose cam 40 in the slot 38 is preferred, the cam 40 can be mounted adjacent the body outer surface 28, and not in a slot, without departing from the scope of the invention.

Referring back to FIG. 2, the cam 40 is operated by a lever 48 extending past the body distal end 32, and pivots the cam 40 about the cam axis 42. Preferably, the lever 48 extends at an angle relative to the cam axis 42 over the body distal end 32. Although a lever 48 is preferred, structure for moving the cam between the open and closed positions, such as a knob fixed to an end of the cam, a lever extending radially from the cam adjacent the flange, and the like, can be used without departing from the scope of the invention.

Referring now to FIGS. 3–6, an over-center biasing mechanism 50 biases the cam 40 to either the open position or the closed position. The mechanism 50 disclosed herein includes a spring 54 having one end 56 fixed relative to the flange 34 and an opposing end 58 fixed to an over-center bracket 62. The spring 54 urges the cam 40 toward one of the closed position and open position depending upon the position of the over-center bracket 62, and thus the cam 40. In particular, the over-center bracket 62 is pivotally mounted to the flange 34 at a pivot point 64, such that the spring opposing end 58 fixed to the over-center bracket 62 moves along an arc as the cam 40, and thus the over-center bracket 62, is rotated between the open and closed positions which causes the spring 54 to move past the pivot point 64. As a result, when the cam 40 is rotated beyond a predetermined point (i.e. when the spring passes the pivot point) toward the cam closed position (shown in FIG. 5), the spring 54 urges the cam 40 toward the closed position. Likewise, when the cam 40 is rotated toward the open position past the predetermined point (shown in FIG. 6), the spring 54 urges the cam 40 toward the open position. Advantageously, this arrangement maintains the cam 40 in the desired position (i.e. open or closed) without the user holding the cam 40 against the urging of the spring 54.

In the preferred embodiment shown in FIGS. 3 and 7, the cam 40 is rotated to the closed position in the same direction as the spool direction of rotation 68 for winding the release liner 70 thereon, such that the cam 40 is self-energizing. In particular, by mounting the cam 40 and over-center biasing mechanism 50 such that the cam 40 is rotated to the closed position in a direction of rotation 66 which is the same as the spool direction of rotation 68 for winding release liner 70 thereon, as the release liner is wound onto the spool 16, the release liner 70 continues to pulls on the trapping portion 67 of the cam 40 to urge the cam 40 toward the closed position. As a result, if tension increases in the release liner 70, the release liner 70 pulls harder on the cam trapping portion 67 to urge the cam 40 further toward the closed position which traps the release liner 70 more securely between the cam 40 and spool body 26.

Referring to FIGS. 1–7, the release liner 70 is secured to the spool 16 by a user rotating the cam 40 to the open position using the lever 48 to form the gap 44 between the cam 40 and the spool body 26. The release liner 70 is slipped into the gap 44 and the cam 40 is rotated to the closed position using the lever 48. Upon rotating the cam 40 to the closed position, the cam 40 traps the release liner 70 between the cam 40 and spool body 26 to secure the release liner 70 relative to the spool 16 and the radially outwardly extending portion 60 of the cam 40 extends above the body outer surface 28 to define an effective diameter of the spool 16 that is greater than the effective diameter of the spool 16 defined by the outer surface 28 of the spool body 26 or by the cam 40 in the open position. As the release liner 70 is wound onto the spool 16, if tension in the release liner 70 increases, the release liner 70 pulls on the trapping portion 67 of the cam 40 to more firmly secure the release liner 70 against the spool body 26.

The release liner 70 is removed from the spool 16 by the user rotating the cam 40 to the open position using the lever 48 to form the gap 44 between the cam 40 and the spool body 26 and release the release liner 70 from between the cam 40 and spool body 26. Advantageously, in the open position, the radially outwardly extending portion 60 of the cam 40 is retracted closer to the spool body 26 to reduce the effective diameter of the spool 16. The reduced effective diameter of the spool 16 allows the roll of release liner 70 wound onto the spool 16 to slip easily in the axial direction past the distal end 32 of the spool body 26 for easy removal.

Advantageously, the spool 16 disclosed herein does not wind the release liner 70 onto a core. Moreover, the spool 16 provides a spool having a dual purpose cam 40 that simplifies securing and removing material wound onto the spool 16. While there has been shown and described what is at present considered the preferred embodiment of the invention, it will be obvious to those skilled in the art that various changes and modifications can be made therein without departing from the scope of the invention defined by the appended claims.

We claim:

1. A spool suitable for winding material thereon, said spool comprising:

an axially extending body having a proximal end and a distal end joined by an outer surface;

an axially extending slot formed in said body outer surface;

a cam disposed in said slot and rotatable mounted for movement between a closed position and an open position, wherein in said closed position, said cam secures the material to the spool and a portion of said cam extends out of said slot to define an effective diameter of said spool, and in said open position, said cam is spaced from said body defining a gap between said outer surface of said body and said cam for receiving the material between said body and said cam and at least a portion of said cam retracts toward said body outer surface to decrease the effective diameter of said spool compared to when said cam is in said closed position, in which said body is rotatably mounted for rotation in one direction to wind material thereon, and said cam is rotatably mounted for rotation in the same direction to move said cam from said open position to said closed position, wherein winding the material onto said spool urges said cam toward said closed position.

2. The spool as in claim 1, in which said cam is biased toward at least one of said open position and said closed position.

3. The spool as in claim 2, in which said cam is biased by an over-center biasing mechanism that biases said cam to either of said open position and said closed position depending upon the position of said cam.

4. The spool as in claim 1, in which said cam is rotatably mounted to a flange fixed to said proximal end of said body.

5. The spool as in claim 1, in which a lever fixed to said cam extends past said body distal end for grasping by a user.

6. The spool as in claim 1, in which said cam extends axially in said slot.

7. A spool suitable for winding material thereon, said spool comprising:

an axially extending body having a proximal end and a distal end joined by an outer surface; and a cam rotatable mounted adjacent to said body for movement between a closed position and an open position, wherein in said closed position, said cam secures a material to the spool and a portion of said cam extends radially outwardly from said body to define a first effective diameter of said spool, and in said open position, said cam is spaced from said body defining a gap between said outer surface of said body and said cam for receiving the material between said body and said cam and said portion of said cam retracts toward said body to define a second effective diameter of said spool which is less than said first effective diameter, in which said body is rotatably mounted for rotation in one direction to wind material thereon, and said cam is rotatably mounted for rotation in the same direction to move said cam from said open position to said closed position, wherein winding the material onto said spool urges said cam toward said closed position.

8. The spool as in claim 7, in which said body includes an axially extending slot, and said cam is disposed in said slot, wherein in said closed position, said cam secures a material to the spool and a portion of said cam extends out of said slot to define the first effective diameter of said spool, and in said open position, said cam is spaced from said body to release the material secured to the spool and at least a portion of said cam retracts into said slot to define said second effective diameter of said spool.

9. The spool as in claim 8, in which said cam extends axially in said slot.

10. The spool as in claim 7, in which said cam is biased toward at least one of said open position and said closed position.

11. The spool as in claim 10, in which said cam is biased by an over-center biasing mechanism that biases said cam to either of said open position and said closed position depending upon the position of said cam.

12. The spool as in claim 7, in which said cam is rotatably mounted to a flange fixed to said proximal end of said body.

13. The spool as in claim 7, in which a lever fixed to said cam extends past said body distal end for grasping by a user.

14. A spool suitable for winding material thereon, said spool comprising:

an axially extending body having a proximal end and a distal end joined by an outer surface; and a cam rotatably mounted adjacent to said body for movement between a closed position and an open position, wherein in said closed position, said cam secures a material to the spool and a portion of said cam extends radially outwardly from said body to define a first effective diameter of said spool, and in said open position, said cam is spaced from said body and said portion of said cam retracts toward said body to define a second effective diameter of said spool which is less than said first effective diameter, said body being rotatably mounted for rotation in one direction to wind material thereon, and said cam is rotatably mounted for rotation in the same direction to move said cam from said open position to said closed position, wherein winding the material onto said spool urges said cam toward said closed position.

15. The spool as in claim 14, in which said body includes an axially extending slot, and said cam is disposed in said slot, wherein in said closed position, said cam secures the material against said outer surface of said body and a portion of said cam extends out of said slot to define the first effective diameter of said spool, and in said open position, said cam is spaced from said body to release the material secured against said outer surface of said body and at least a portion of said cam retracts into said slot to define said second effective diameter of said spool.

16. The spool as in claim 14, in which said cam is biased toward at least one of said open position and said closed position.

17. The spool as in claim 14, in which said cam is biased by an over-center biasing mechanism that biases said cam to either of said open position and said closed position depending upon the position of said cam.

18. The spool as in claim 14, in which said cam is rotatably mounted to a flange fixed to said proximal end of said body.

* * * * *

UNITED STATES PATENT AND TRADEMARK OFFICE

CERTIFICATE OF CORRECTION

PATENT NO. : 7,128,290 B1
APPLICATION NO. : 10/885452
DATED : October 31, 2006
INVENTOR(S) : Bandholz et al.

It is certified that error appears in the above-identified patent and that said Letters Patent is hereby corrected as shown below:

Column 5, line 18 “rotatable” should be changed to -- rotatably --

Column 5, line 53 “rotatable” should be changed to -- rotatably --

Signed and Sealed this

Tenth Day of April, 2007

JON W. DUDAS
*Director of the United States Patent and Trademark Office*